US008374362B2

(12) United States Patent
Ramakrishnan et al.

(10) Patent No.: US 8,374,362 B2
(45) Date of Patent: Feb. 12, 2013

(54) SIGNALING MICROPHONE COVERING TO THE USER

(75) Inventors: Dinesh Ramakrishnan, San Diego, CA (US); Ravi Satyanarayanan, San Diego, CA (US); Song Wang, San Diego, CA (US); Eddie L. T. Choy, Carlsbad, CA (US)

(73) Assignee: QUALCOMM Incorporated, San Diego, CA (US)

( * ) Notice: Subject to any disclaimer, the term of this patent is extended or adjusted under 35 U.S.C. 154(b) by 1264 days.

(21) Appl. No.: 12/023,970

(22) Filed: Jan. 31, 2008

(65) Prior Publication Data

US 2009/0196429 A1 Aug. 6, 2009

(51) Int. Cl.
*H04R 3/00* (2006.01)

(52) U.S. Cl. ..... 381/122

(58) Field of Classification Search ..... 381/122
See application file for complete search history.

(56) References Cited

U.S. PATENT DOCUMENTS

| | | | | |
|---|---|---|---|---|
| 5,524,059 | A | 6/1996 | Zurcher | |
| 5,978,490 | A * | 11/1999 | Choi et al. | 381/92 |
| 6,705,319 | B1 * | 3/2004 | Wodicka et al. | 128/207.14 |
| 7,492,909 | B2 | 2/2009 | Carter, Jr. | |
| 2002/0037088 | A1 * | 3/2002 | Dickel et al. | 381/317 |
| 2004/0057593 | A1 * | 3/2004 | Pedersen et al. | 381/321 |
| 2004/0165735 | A1 | 8/2004 | Opitz | |
| 2004/0240676 | A1 * | 12/2004 | Hashimoto et al. | 381/56 |
| 2005/0213778 | A1 * | 9/2005 | Buck et al. | 381/94.3 |
| 2005/0239516 | A1 * | 10/2005 | Gonopolskiy | 455/570 |
| 2005/0276423 | A1 | 12/2005 | Aubauer et al. | |
| 2006/0120540 | A1 * | 6/2006 | Luo | 381/98 |
| 2006/0198529 | A1 * | 9/2006 | Kjems et al. | 381/26 |
| 2007/0047744 | A1 * | 3/2007 | Harney et al. | 381/113 |
| 2007/0086602 | A1 * | 4/2007 | Petersen et al. | 381/92 |
| 2008/0013749 | A1 * | 1/2008 | Konchitsky | 381/94.7 |

(Continued)

FOREIGN PATENT DOCUMENTS

| | | |
|---|---|---|
| EP | 1191817 A1 | 3/2002 |
| EP | 1458216 A2 | 9/2004 |

(Continued)

OTHER PUBLICATIONS

International Search Report and Written Opinion—PCT/US09/032407, International Searching Authority—European Patent Office, May 7, 2009.

(Continued)

*Primary Examiner* — Steven Loke
*Assistant Examiner* — Igwe U Anya
(74) *Attorney, Agent, or Firm* — Espartaco Diaz Hidalgo

(57) ABSTRACT

A mechanism is provided that monitors secondary microphone signals, in a multi-microphone mobile device, to warn the user if one or more secondary microphones are covered while the mobile device is in use. In one example, smoothly averaged power estimates of the secondary microphones may be computed and compared against the noise floor estimate of a primary microphone. Microphone covering detection may be made by comparing the secondary microphone smooth power estimates to the noise floor estimate for the primary microphone. In another example, the noise floor estimates for the primary and secondary microphone signals may be compared to the difference in the sensitivity of the first and second microphones to determine if the secondary microphone is covered. Once detection is made, a warning signal may be generated and issued to the user.

37 Claims, 8 Drawing Sheets

U.S. PATENT DOCUMENTS

| | | | | |
|---|---|---|---|---|
| 2009/0190769 | A1* | 7/2009 | Wang et al. | 381/66 |
| 2009/0323977 | A1* | 12/2009 | Kobayashi et al. | 381/71.8 |

FOREIGN PATENT DOCUMENTS

| | | | |
|---|---|---|---|
| JP | 2002540696 | A | 11/2002 |
| JP | 2004343700 | A | 12/2004 |
| RU | 2096928 | C1 | 11/1997 |
| RU | 2198482 | C2 | 2/2003 |
| WO | WO2006021555 | | 3/2006 |

OTHER PUBLICATIONS

Martin, R., "Spectral Subtraction Based on Minimum Statistics," in Proc. Eur. Signal Processing Conf., 1994, pp. 1182-1185.

* cited by examiner

SIGNALING MICROPHONE COVERING TO THE USER

BACKGROUND

1. Field

At least one aspect relates to monitoring the impact of a user on the performance of a communication system. More specifically, at least one feature relates to detecting microphone covering by the user of the mobile device and issuing a warning to the user so that the user's behavior does not have a detrimental effect on the performance of the communication system.

2. Background

Mobile devices (e.g., mobile phones, digital recorders, communication devices, etc.) are often used in different ways by different users. Such usage diversity could significantly affect the voice quality performance of the mobile devices. The way that a mobile device is used varies from user to user and from time to time for the same user. Users have different communication needs, preferences for functionality, and habits of use that may result in a mobile device being used or held in different positions during operation. For example, one user may like to place the device up-side-down while using it to speak in speakerphone mode. In another example, there may be no line-of-sight (LOS) between a microphone on the mobile device and the user, which may affect voice signal capture. In yet another example, a mobile device may be placed or positioned such that the capture of a desired voice signal by the microphone is blocked or hindered.

Some mobile devices may employ multiple microphones in an effort to improve the quality of the transmitted sound. Such devices typically use advanced signal processing methods to process the signals recorded or captured by multiple microphones and these methods offer various benefits such as improved sound/voice quality, reduced background noise, etc. in the transmitted sound signal. However, covering of the microphones by the user (talker) can hamper the performance of the signal processing algorithms and the intended benefits may not be realized.

The different ways in which users may use a mobile device often affects the reception of the desired sound or voice signals by a microphone on the mobile device, resulting in sound or voice quality degradation (e.g., decrease in signal-to-noise ratio (SNR)). In voice communications, especially mobile voice communications, voice or sound quality is a criterion for quality of service (QoS). The way a mobile device is used is one of many factors that may potentially affect QoS. However, during the normal usage of a mobile device, the user may cover one or more microphones and his/her behavior can degrade the sound/voice quality.

Consequently, a way is needed to alert a user of a mobile device that his/her behavior is having a detrimental effect on the sound/voice quality.

SUMMARY

A method for improving sound capture on a mobile device is provided. A first acoustic signal is received via a primary microphone to obtain a primary sound signal. Similarly, a second acoustic signal is received via a secondary microphone to obtain a secondary sound signal. The first sound signal and the second sound signal may be obtained within overlapping time windows. A first signal characteristic is determined for the primary sound signal and a second signal characteristic is determined for the secondary sound signal. A determination is made as to whether the secondary microphone may be obstructed based on the first signal characteristic and second signal characteristic. A warning may be provided indicating that the secondary microphone may be obstructed. The secondary sound signal may be used to improve the sound quality of the primary sound signal.

According to one feature, determining whether the secondary microphone may be obstructed based on the first signal characteristic and second signal characteristic may include (a) determining whether a ratio between the second signal characteristic and first signal characteristic is less than a threshold, and/or (b) providing the warning if the ratio is less than the threshold. The warning may be provided through at least one of an audio signal, a vibration of the mobile device, and a visual indicator.

The method may also include (a) obtaining a first sensitivity corresponding to a primary microphone and a second sensitivity corresponding to a secondary microphone, and/or (b) obtaining the threshold based on the difference between the first sensitivity and the second sensitivity. The first sensitivity of the primary microphone and second sensitivity of the secondary microphone may be obtained for a given level of sound pressure.

Another aspect provides for (a) processing the primary sound signal to either reduce noise or enhance sound quality by using the secondary sound signal, and/or (b) transmitting the processed primary sound signal to an intended listener over a communication network.

According to one feature, the first signal characteristic may be a first noise level for the primary sound signal and the second signal characteristic may be a second noise level for the secondary sound signal. The first noise level may be a first noise floor level and the second noise level may be a second noise floor level. The first and second noise floor levels may be smoothened for the first and second sound signals. Alternatively, the first signal characteristic may be a first noise level for the primary sound signal and the second signal characteristic may be a second power level for the secondary sound signal.

According to one aspect, obtaining the first signal characteristic for the primary sound signal may include (a) segmenting the primary sound signal it into a first plurality of frames, (b) estimating a block power for each of the first plurality of frames, and/or (c) searching for a minimum energy term in the first plurality of frames to obtain a first noise floor estimate for the primary sound signal, wherein the first noise floor estimate is the noise level for the primary sound signal. Similarly, obtaining the second signal characteristic for the secondary sound signal may include (a) segmenting the secondary sound signal it into a second plurality of frames, (b) estimating a block power for each of the second plurality of frames, and/or (c) searching for a minimum energy term in the second plurality of frames to obtain a second noise floor estimate for the primary sound signal, wherein the second noise floor estimate is the noise level for the secondary sound signal. Determining whether the secondary microphone may be obstructed may include (a) obtaining a ratio of the second noise floor estimate to the first noise floor estimate, and/or (b) determining whether the ratio is less than a threshold.

According to another aspect, the method may also include (a) obtaining a block power estimate for the secondary sound signal for the secondary microphone, (b) obtaining a smoothening factor for the secondary sound signal, (c) obtaining a smooth block power estimate for the secondary sound signal based on the smoothening factor and the block power estimate, (d) obtaining a first noise floor estimate for a primary microphone signal block for the primary microphone, (e) obtaining a ratio between the smooth block power estimate and the first noise floor estimate, and/or (f) determining whether the ratio is less than a threshold.

Yet another aspect provides for dynamically selecting the primary microphone from a plurality of microphones based on which microphone has either the highest signal energy or highest signal-to-noise ratio at a particular period of time.

A mobile device is also provided comprising: a primary microphone, a secondary microphone, and a secondary microphone cover detection module. The primary microphone may be configured to obtain a first sound signal. The secondary microphone may be configured to obtain a second sound signal. The secondary microphone cover detection module may be configured or adapted to (a) determine a first signal characteristic for the primary sound signal, (b) determine a second signal characteristic for the secondary sound signal, (c) determine whether the secondary microphone may be obstructed based on the first signal characteristic and second signal characteristic, and/or (d) provide a warning indicating that the secondary microphone may be obstructed. The warning may be provided through at least one of an audio signal, a vibration of the mobile device, and a visual indicator. The first sound signal and the second sound signal may be obtained within overlapping time windows. The second sound signal may be used to improve the sound quality of the first sound signal.

In determining whether the secondary microphone may be obstructed based on the first signal characteristic and second signal characteristic, the secondary microphone cover detection module may be further configured or adapted to determine whether a ratio between the second signal characteristic and first signal characteristic is less than a threshold. The secondary microphone cover detection module may be further configured or adapted to (a) obtain a first sensitivity corresponding to the primary microphone and a second sensitivity corresponding to the secondary microphone, wherein the first sensitivity of the primary microphone and second sensitivity of the secondary microphone are obtained for a given level of sound pressure, and/or (b) obtain a threshold based on the difference between the first sensitivity and the second sensitivity.

The secondary microphone cover detection module may be further configured or adapted to (a) process the first sound signal to either reduce noise or enhance sound quality by using the secondary sound signal, and/or (b) transmit the processed primary sound signal to an intended listener over a communication network.

The primary and secondary microphones may be selected from a plurality of microphones mounted on different surfaces of the mobile device. Consequently, the secondary microphone cover detection module may be further configured or adapted to dynamically select the primary microphone from the plurality of microphones based on which microphone has either the highest signal energy or highest signal-to-noise ratio at a particular period of time.

The first signal characteristic may be a first noise floor estimate for the primary sound signal and the second signal characteristic may be a second noise floor estimate for the secondary sound signal. Consequently, the secondary microphone cover detection module may be further configured or adapted to determine whether a ratio between the second noise floor estimate and the first noise floor estimate is less than a threshold.

The first signal characteristic is a first noise floor estimate for the primary sound signal and the second signal characteristic is a second smoothened power estimate for the secondary sound signal. Consequently, the secondary microphone cover detection module may be further configured or adapted to determine whether a ratio between the second smoothened power estimate and the first noise floor estimate is less than a threshold.

Consequently, a mobile device is provided comprising: (a) means for receiving a first acoustic signal via a primary microphone to obtain a primary sound signal, (b) means for receiving a second acoustic signal via a secondary microphone to obtain a secondary sound signal, (c) means for determining a first signal characteristic for the primary sound signal, (d) means for determining a second signal characteristic for the secondary sound signal, (e) means for determining whether the secondary microphone may be obstructed based on the first signal characteristic and second signal characteristic, and/or (f) means for providing a warning indicating that the secondary microphone may be obstructed. The first signal characteristic may be a first noise floor estimate for the primary sound signal and the second signal characteristic is a second noise floor estimate for the secondary sound signal. The first signal characteristic is a first noise floor estimate for the primary sound signal and the second signal characteristic is a second smoothened power estimate for the secondary sound signal.

A circuit is also provided for improving sound capture, wherein the circuit is adapted or configured to (a) receive a first acoustic signal via a primary microphone to obtain a primary sound signal, (b) receive a second acoustic signal via a secondary microphone to obtain a secondary sound signal, (c) obtain a first signal characteristic for the primary sound signal, (d) obtain a second signal characteristic for the secondary sound signal, (e) determine whether the secondary microphone may be obstructed based on the first signal characteristic and second signal characteristic, and/or (f) provide a warning indicating that the secondary microphone may be obstructed. The first signal characteristic may be a first noise floor estimate for the primary sound signal and the second signal characteristic may be a second noise floor estimate for the secondary sound signal. According to one aspect, in determining whether the secondary microphone may be obstructed, the circuit may be further adapted to determine whether a ratio between the second noise floor estimate and the first noise floor estimate is less than a threshold. The first signal characteristic may be a first noise floor estimate for the primary sound signal and the second signal characteristic may be a second smoothened power estimate for the secondary sound signal. According to another aspect, in determining whether the secondary microphone may be obstructed, the circuit may be further adapted to determine whether a ratio between the second smoothened power estimate and the first noise floor estimate is less than a threshold. In one example, the circuit may be implemented as an integrated circuit.

A computer-readable medium is also provided comprising instructions improving sound capture on a mobile device, which when executed by a processor causes the processor to (a) receive a first acoustic signal via a primary microphone to obtain a primary sound signal, (b) receive a second acoustic signal via a secondary microphone to obtain a secondary sound signal, (c) determine a first signal characteristic for the primary sound signal, (d) determine a second signal characteristic for the secondary sound signal, (e) determine whether the secondary microphone may be obstructed based on the first signal characteristic and second signal characteristic, (f) provide a warning indicating that the secondary microphone may be obstructed, and/or (g) dynamically select the primary microphone from the plurality of microphones based on which microphone has either the highest signal energy or highest signal-to-noise ratio at a particular period of time.

BRIEF DESCRIPTION OF THE DRAWINGS

Various features, nature, and advantages may become apparent from the detailed description set forth below when taken in conjunction with the drawings in which like reference characters identify correspondingly throughout.

DETAILED DESCRIPTION

Figure 1:
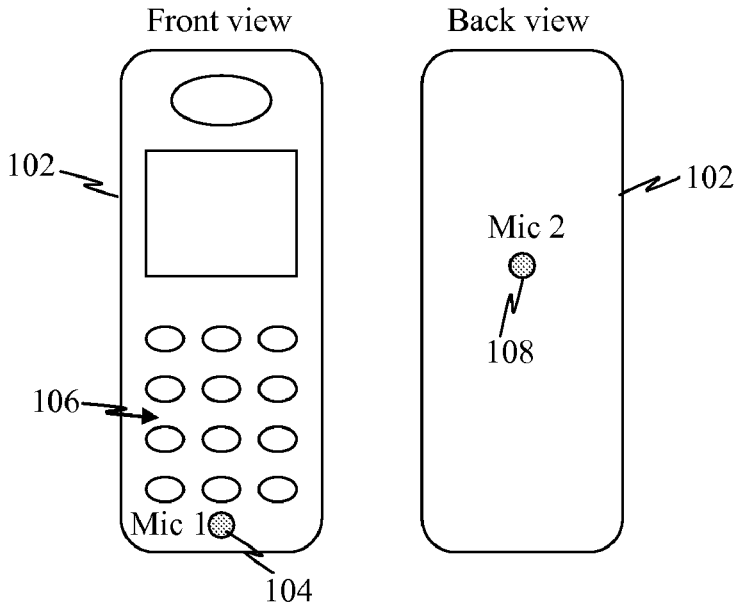
FIG. 1 illustrates an example of a mobile phone having two or more microphones for improved sound/voice signal capture.

In the following description, specific details are given to provide a thorough understanding of the configurations. However, it will be understood by one of ordinary skill in the art that the configurations may be practiced without these specific detail. For example, circuits may be shown in block diagrams in order not to obscure the configurations in unnecessary detail. In other instances, well-known circuits, structures and techniques may be shown in detail in order not to obscure the configurations.

Also, it is noted that the configurations may be described as a process that is depicted as a flowchart, a flow diagram, a structure diagram, or a block diagram. Although a flowchart may describe the operations as a sequential process, many of the operations can be performed in parallel or concurrently. In addition, the order of the operations may be re-arranged. A process is terminated when its operations are completed. A process may correspond to a method, a function, a procedure, a subroutine, a subprogram, etc. When a process corresponds to a function, its termination corresponds to a return of the function to the calling function or the main function.

In one or more examples and/or configurations, the functions described may be implemented in hardware, software, firmware, or any combination thereof. If implemented in software, the functions may be stored on or transmitted over as one or more instructions or code on a computer-readable medium. Computer-readable media includes both computer storage media and communication media including any medium that facilitates transfer of a computer program from one place to another. A storage media may be any available media that can be accessed by a general purpose or special purpose computer. By way of example, and not limitation, such computer-readable media can comprise RAM, ROM, EEPROM, CD-ROM or other optical disk storage, magnetic disk storage or other magnetic storage devices, or any other medium that can be used to carry or store desired program code means in the form of instructions or data structures and that can be accessed by a general-purpose or special-purpose computer, or a general-purpose or special-purpose processor. Also, any connection is properly termed a computer-readable medium. For example, if the software is transmitted from a website, server, or other remote source using a coaxial cable, fiber optic cable, twisted pair, digital subscriber line (DSL), or wireless technologies such as infrared, radio, and microwave, then the coaxial cable, fiber optic cable, twisted pair, DSL, or wireless technologies such as infrared, radio, and microwave are included in the definition of medium. Disk and disc, as used herein, includes compact disc (CD), laser disc, optical disc, digital versatile disc (DVD), floppy disk and blu-ray disc where disks usually reproduce data magnetically, while discs reproduce data optically with lasers. Combinations of the above are also be included within the scope of computer-readable media.

Moreover, a storage medium may represent one or more devices for storing data, including read-only memory (ROM), random access memory (RAM), magnetic disk storage mediums, optical storage mediums, flash memory devices and/or other machine readable mediums for storing information.

Furthermore, configurations may be implemented by hardware, software, firmware, middleware, microcode, or any combination thereof. When implemented in software, firmware, middleware or microcode, the program code or code segments to perform the necessary tasks may be stored in a computer-readable medium such as a storage medium or other storage(s). A processor may perform the necessary tasks. A code segment may represent a procedure, a function, a subprogram, a program, a routine, a subroutine, a module, a software package, a class, or any combination of instructions, data structures, or program statements. A code segment may be coupled to another code segment or a hardware circuit by passing and/or receiving information, data, arguments, parameters, or memory contents. Information, arguments, parameters, data, etc. may be passed, forwarded, or transmitted via any suitable means including memory sharing, message passing, token passing, network transmission, etc.

In a mobile device containing two or more microphones, all microphones other than the primary microphone may be referred to as secondary microphones. One feature provides a mechanism that monitors secondary microphone signals, in a multi-microphone mobile device, to warn the user if one or more secondary microphones are covered while the mobile device is in use. A method is provided to detect whether any of the secondary microphones in the mobile device are covered. Various signal characteristics for signals from the primary microphone and the secondary microphone may be used to determine if a secondary microphone has been covered or obstructed. Such signal characteristics may include, for example, signal power, signal-to-noise ratio (SNR), energy, correlation, combinations thereof and/or derivations thereof. For instance, one approach may compute smoothly averaged power estimates of the secondary microphones and compare them against the noise floor estimate of a primary microphone. Microphone covering detection is made by comparing the secondary microphone smooth power estimates with a noise floor estimate for the primary microphone. Once detection is made, a warning signal is generated and issued to the controlling processor of the mobile device. The warning to the user may be implemented in various ways including vibration of the mobile device, sound signals to the user, display of a message on a mobile device display, for example. The warning system may be helpful to the user and the user may derive improved sound capture from a multi-microphone mobile device.

FIG. 1 illustrates an example of a mobile phone 102 having two or more microphones for improved sound/voice signal capture. A first microphone 104 may be positioned on a front surface of the mobile phone 102, adjacent to the key pad 106 for example. A second microphone 108 may be positioned on a back surface of the mobile phone 102 opposite the front surface, near the middle of the back surface for example. The location of the first and second microphones 104 and 108 may be selected such that it is very unlikely that both microphones can be blocked at the same time.

Figure 2:
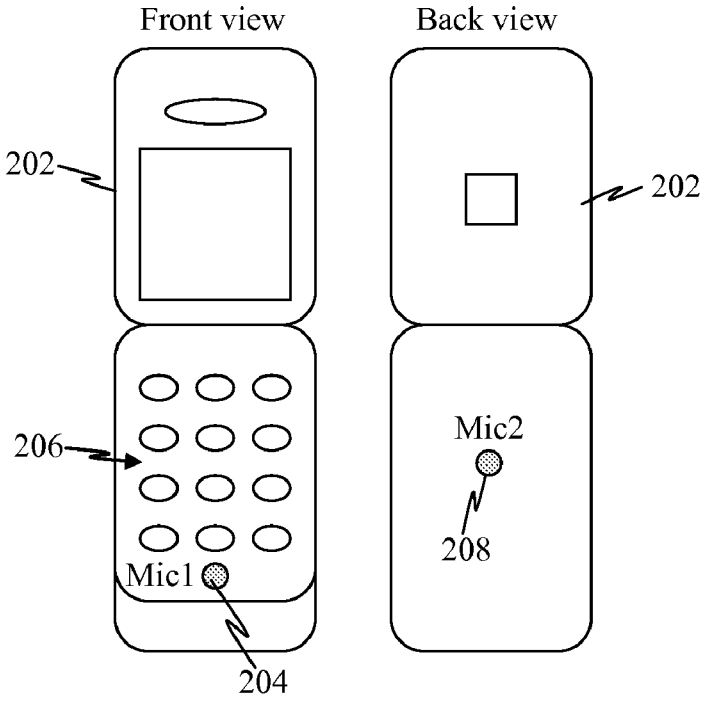
FIG. 2 illustrates an example of a folding mobile phone having two or more microphones for improved sound/voice signal capture.

FIG. 2 illustrates an example of a folding mobile phone 202 having two or more microphones for improved sound/voice signal capture. A first microphone 204 may be positioned on a front surface of the mobile phone 202, adjacent to the key pad 206 for example. A second microphone 208 may be positioned on a back surface of the mobile phone 202 opposite the front surface. The location of the first and second microphones 204 and 208 may be selected such that it is very unlikely that both microphones can be blocked or obstructed at the same time.

The multi-microphone mobile devices 102 and 202 in FIGS. 1 and 2 may allow the user to talk in diverse environments, including noisy areas such as outdoors, restaurants, malls, etc. and the issue of improving the quality of the transmitted voice is even more important. A solution for improving the voice quality under noisy scenarios may be to equip the mobile device with multiple microphones and use advanced signal processing techniques to suppress the background noise in the captured voice signal prior to transmission. In some methods, the speech/audio enhancement benefits offered by the signal processing techniques are realized by the use of multiple microphones that are allowed to function properly.

The mobile devices 102 and 202 may be configured or adapted to detect microphone coverings and issue a warning signal to the user. Issuance of warning signal can be helpful in maintaining the high voice quality provided by multi-microphone signal processing solutions. However, the techniques described herein are not limited to any particular method of detection or to any particular mobile device. The detection and warning system may be used in a mobile device that uses multiple microphones. Furthermore, the particular type of warning system used is not constrained by this disclosure. The mobile device manufacturer or the mobile carrier may use our detection mechanism to implement their desired type of warning system.

Multiple microphone signal processing solutions may be used in mobile voice communication systems for achieving higher voice quality even in hostile environments. Due to limitations of space on a mobile device, two-microphone solutions may be used. While some of the examples described herein may utilize two microphones, the methods are not limited to two microphone devices and can be implemented in a mobile device with more than two microphones as well.

For example, consider the mobile devices 102 and 202 with two microphones where one microphone is mounted on the front and the other microphone is mounted on the back of the device. In one configuration, the microphone on the front may be primarily used for recording the desired speech coming from the user of the mobile device. Many mobile devices have at least one microphone on the front or at least close to the mouth of the user so that it can capture the desired speech or sound. This first microphone 104 and 204 may be referred to as a primary microphone. A primary microphone may be selected such that it is unlikely to be covered (e.g., accidentally, unintentionally, purposefully or otherwise) during use. The second microphone 108 and 208 on the back of the mobile device may be used for capturing extra information, such as information about the background noise. The second microphone 108 and 208 may be referred to as a secondary microphone since its signal is used to improve a signal from a primary microphone. The extra information is utilized by the advanced signal processing techniques for suppressing background noise and enhancing voice quality. The signal processing algorithms rely on the second microphone to obtain such extra information for improving speech in noisy scenarios. However, it is not uncommon for the user to cover, obstruct, or otherwise block the back (secondary) microphone (e.g., by accident or on purpose) while talking. In this case, the performance of the signal processing algorithm suffers as it may not be able to extract useful information from the secondary microphone signal. In some cases, the user may partially cover the back (secondary) microphone 108 and 208 or he/she may gradually cover the back microphone over a period of time. In this case, the performance of the signal processing algorithm may deteriorate over a period of time. In either case, the advantage of having a secondary microphone on the mobile device is lost either completely or partially.

To rectify the problem of covering of a secondary microphone, the mobile devices 102 and 202 may be configured or adapted to detect when or if a microphone is fully or partially covered, obstructed, or otherwise blocked and warn the user of such situation. According to one example, the energy levels and/or noise floors for a primary microphone and at least one secondary microphone may be obtained and compared to detect whether the second microphone is covered, obstructed or blocked. Once detection is made, a warning signal may be issued to the user. The warnings may be repeated until the user uncovers the affected secondary microphone. Furthermore, the detector output can also be exploited by the advanced signal processing modules in the mobile device. If a mobile device contains more than two microphones, all microphones other than the primary microphone may be referred to as secondary microphones.

In some configurations, a primary microphone may be dynamically selected from a plurality of microphones based on which microphone has the best signal quality at a particular period of time. For example, the microphone having the largest signal energy (e.g., signal power) or signal to noise ratio (SNR) may be selected as the primary microphone while one or more of the remaining microphones are used as secondary microphones.

Figure 3:
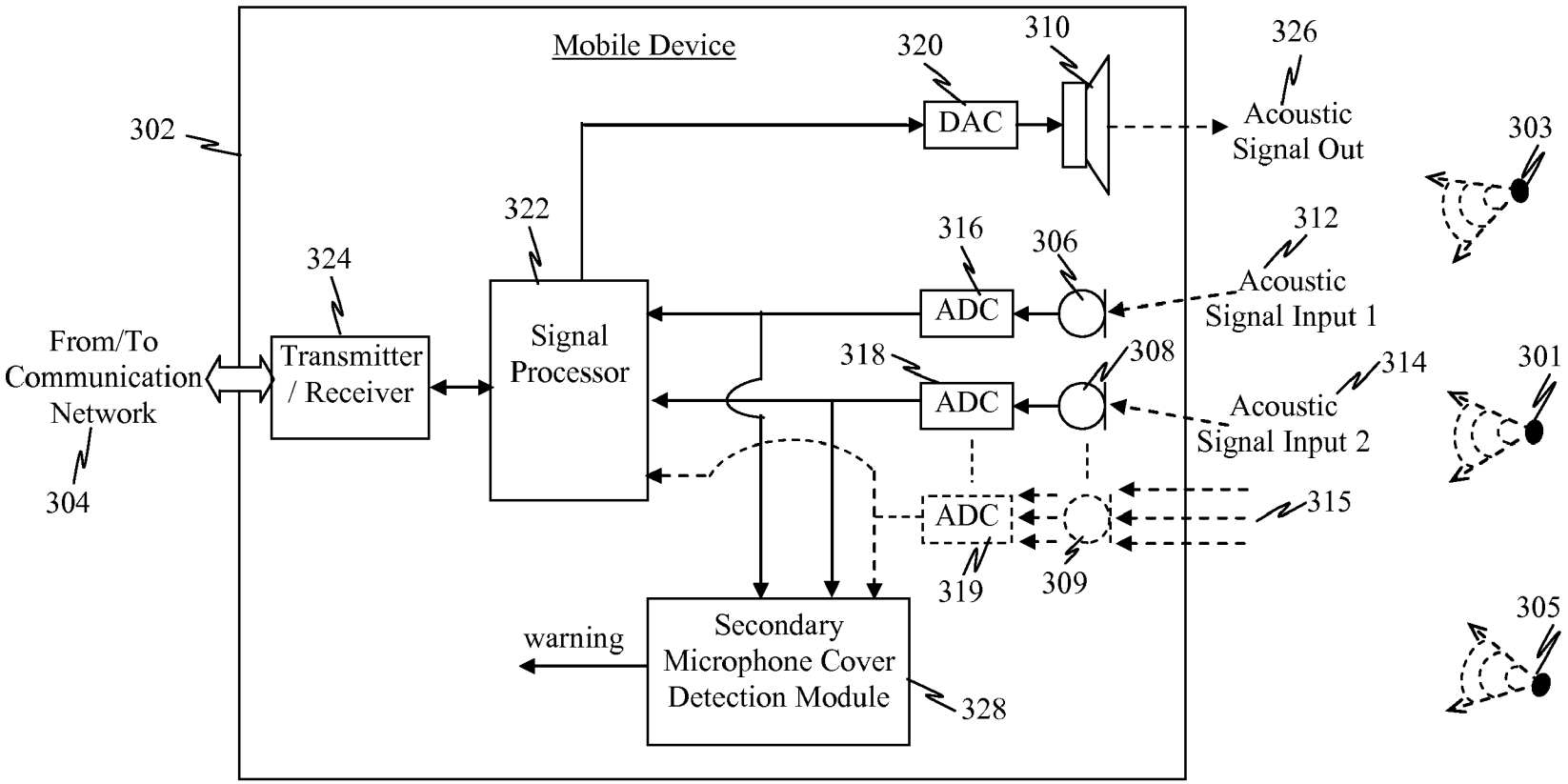
FIG. 3 is a functional block diagram illustrating an example of a multi-microphone mobile device configured to detect when a secondary microphone is obstructed.

FIG. 3 is a functional block diagram illustrating an example of a multi-microphone mobile device configured to detect when a secondary microphone is obstructed. The mobile device 302 may be a mobile phone or other communication device that serves to facilitate communications between a user and a remote listener over a communication network 304. The mobile device 302 may include at least a primary microphone 306, one or more secondary microphones 308 and 309, and at least one speaker 310. The microphones 306, 308 and/or 309 may receive acoustic signals inputs 312, 314 and 315 from one or more sound sources 301, 303, and 305 which are then digitized by analog-to-digital converters 316, 318 and 319. The acoustic signal may include desired sound signals and undesired sound signals. The term "sound signal" includes, but is not limited to, audio signals, speech signals, noise signals, and/or other types of signals that may be acoustically transmitted and captured by a microphone. A primary microphone 306 may be mounted such that it is close to the mouth of the user under typical operation. The one or more secondary microphones 308 and 309 may be mounted at various surfaces of the mobile device 302 so as to improve sound capture.

A secondary microphone cover detection module 328 may be configured or adapted to receive the digitized acoustic signals 312, 314 and 315 and determine whether the corresponding secondary microphone is fully or partially obstructed, blocked, or otherwise impaired. Such determination may be made by comparing a first signal characteristic from the primary microphone 306 and a second signal characteristic from the secondary microphone 308. Such signal characteristics may include, for example, signal power, signal-to-noise ratio (SNR), energy, correlation, combinations thereof and/or derivations thereof.

The response of a microphone to a given level of sound pressure may be quantified by a factor called sensitivity. If a microphone has high sensitivity, it produces a high signal level for a given level of sound pressure. In a typical mobile device, the sensitivities of the primary and secondary microphones may differ, for example, by as much as six (6) dB. To allow for higher difference margins, one configuration may assume that the sensitivities of the primary and secondary microphones 306 and 308 may differ by as much as twelve (12) dB. For example, in a two-microphone mobile device, the secondary microphone cover detection module 328 may monitor the background noise level in the primary microphone 306 and the secondary microphone 308 and then may compare the two noise levels to detect covering of the secondary microphone 308. If the sensitivities of the two microphones 306 and 308 are identical, then the noise levels in the two microphone signals are likely to be close to each other. Even if the two microphones 306 and 308 have different sensitivities, the noise level in the secondary microphone signal is not likely to differ by more than twelve (12) to fifteen (15) dB compared to the noise level in the primary microphone signal, since a maximum of twelve (12) dB difference is assumed in the microphone sensitivities. However, if the secondary microphone 308 is covered, noise level in the secondary microphone 308 is likely to become abnormally low (e.g., a difference of more than 12 dB). This principle may be used as the condition for detecting covering of the secondary microphone 308. If the secondary microphone cover detection module 328 determines that the secondary microphone 308 is covered or obstructed, it may generate a warning to the user. The warning may be, for example, a beep sound, a preprogrammed voice message, a ring, or any other audible alert. Similarly, the warning may be, for example, a flash of a mobile device display or icon or message in the display, or any other visible alert. The warning may also be any combination of audible and visible alerts to the user.

In one example, the digitized signals sampled by the analog-to-digital converters 316, 318, and 319 may pass through one or more buffers (which may be part of the detection module 328 or distinct modules, for example) to segment them into blocks or frames. In some examples, a block may comprise a plurality of frames. Such buffers may have preset sizes that store a plurality of signal samples making up a block or frame. An analog-to-digital converter and corresponding buffer may be referred to as a signal segmenter. The comparison between the first signal characteristic for the first signal (primary microphone 306) and the second signal characteristic for the second signal (secondary microphone 308) may then be performed on their corresponding blocks or frames. Such signal characteristics may include, for example, signal power, signal-to-noise ratio (SNR), energy, correlation, combinations thereof and/or derivations thereof.

The mobile device 302 may also include a signal processor 322 configured or adapted to perform one or more operations that improve the quality of the signal 312 from the primary microphone 306 by using the acoustic signal 314 from the secondary microphone 308. For instance, the acoustic signal 314 from the secondary microphone 308 may be used to remove or minimize noise from the primary microphone 306. The resulting signal may then be transmitted over a wireless or wired communication network 304 by a transmitter/receiver module 324.

The mobile device 302 may also receive sound signals from the communication network 304 through the transmitter/receiver module 324, where it may be processed by the signal processor 322 before passing through a digital-to-analog converter 320. The received signal then passes to the at least one speaker 310 so it can be acoustically transmitted to the user as an acoustic signal output 326.

Figure 4:
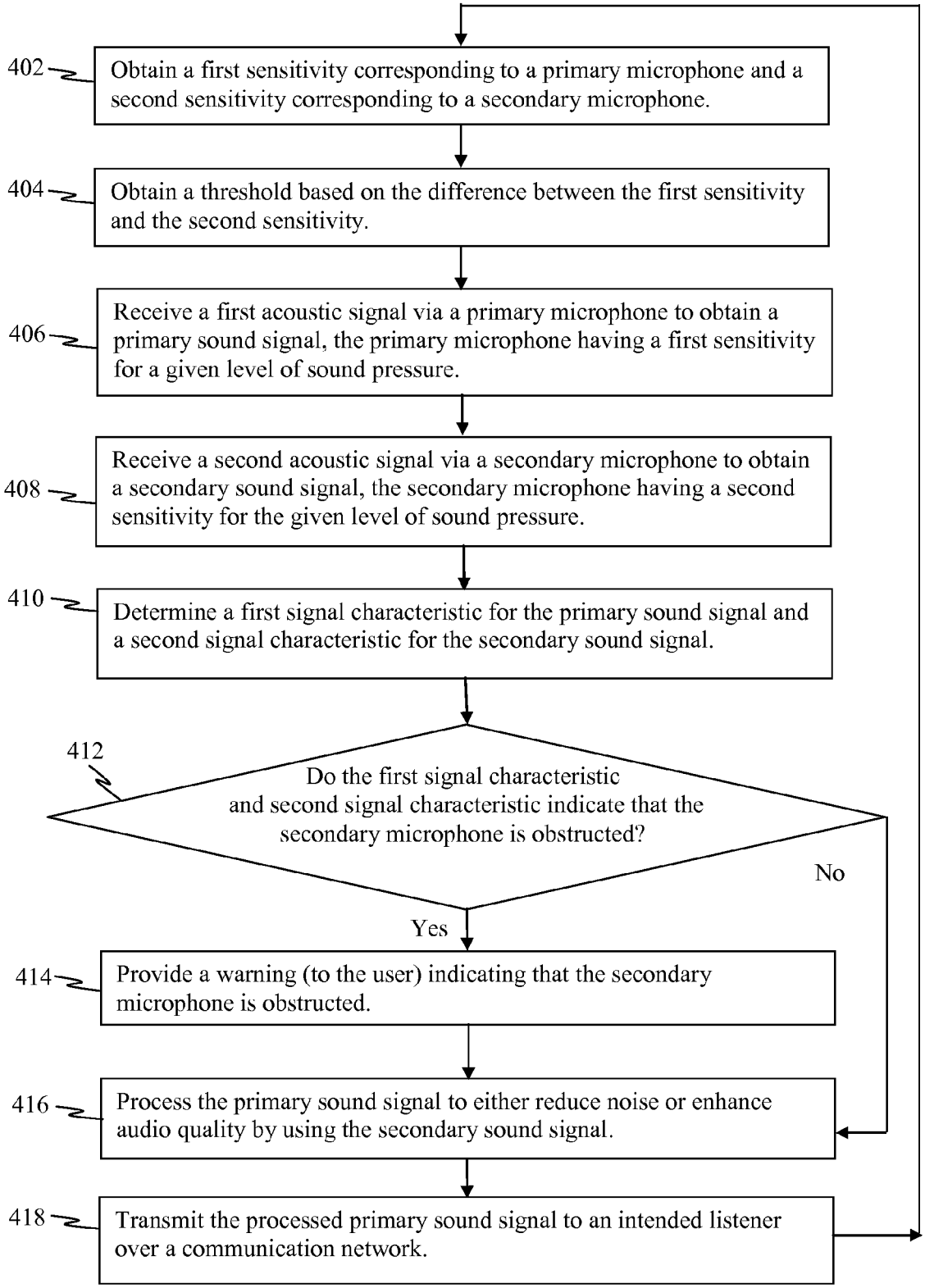
FIG. 4 is a flow diagram illustrating a method operational on a multi-microphone mobile device to detect when a secondary microphone is obstructed.

FIG. 4 is a flow diagram illustrating a method operational on a multi-microphone mobile device to detect when a secondary microphone is obstructed. A first sensitivity corresponding to a primary microphone and a second sensitivity corresponding to a secondary microphone may be obtained 402. The first and second sensitivities may be determined based on a given level of sound pressure. A threshold based on (but not necessarily equal to) the difference between the first sensitivity and the second sensitivity may then be obtained 404. A first acoustic signal is received via the primary microphone to obtain a primary sound signal 406. A second acoustic signal is received via the secondary microphone to obtain a secondary sound signal 408. The first and second acoustic signals may originate from the same source and during the same (or overlapping) time window. A first signal characteristic for the primary sound signal and a second signal characteristic for the secondary sound signal are determined 410. Such signal characteristics may include, for example, signal power, signal-to-noise ratio (SNR), energy, correlation, combinations thereof and/or derivations thereof. For instance, the noise levels and/or power levels for the primary and secondary sound signals may be determined or obtained.

A determination is then made as to whether the secondary microphone may be obstructed based on the first signal characteristic and second signal characteristic 412. For instance, if a ratio between the first signal characteristic and second signal characteristic is less than a threshold, it may be concluded that the secondary microphone is obstructed or covered. In one example, such comparison may be between a ratio between a second noise level for the secondary sound signal and a first noise level for the primary sound signal. Alternatively, the comparison may be performed as a ratio between a power level of the secondary sound signal and a noise level of the primary sound signal. If the secondary microphone is determined to be obstructed, a warning is provided (to the user) indicating that the secondary microphone may be obstructed 414. The primary sound signal may then be processed to either reduce noise or enhance audio/sound quality (or both) by using the secondary sound signal 416. The processed primary sound signal may then be transmitted to an intended listener over a communication network 418.

Estimation of Noise Level in Microphone Signals

Figure 5:
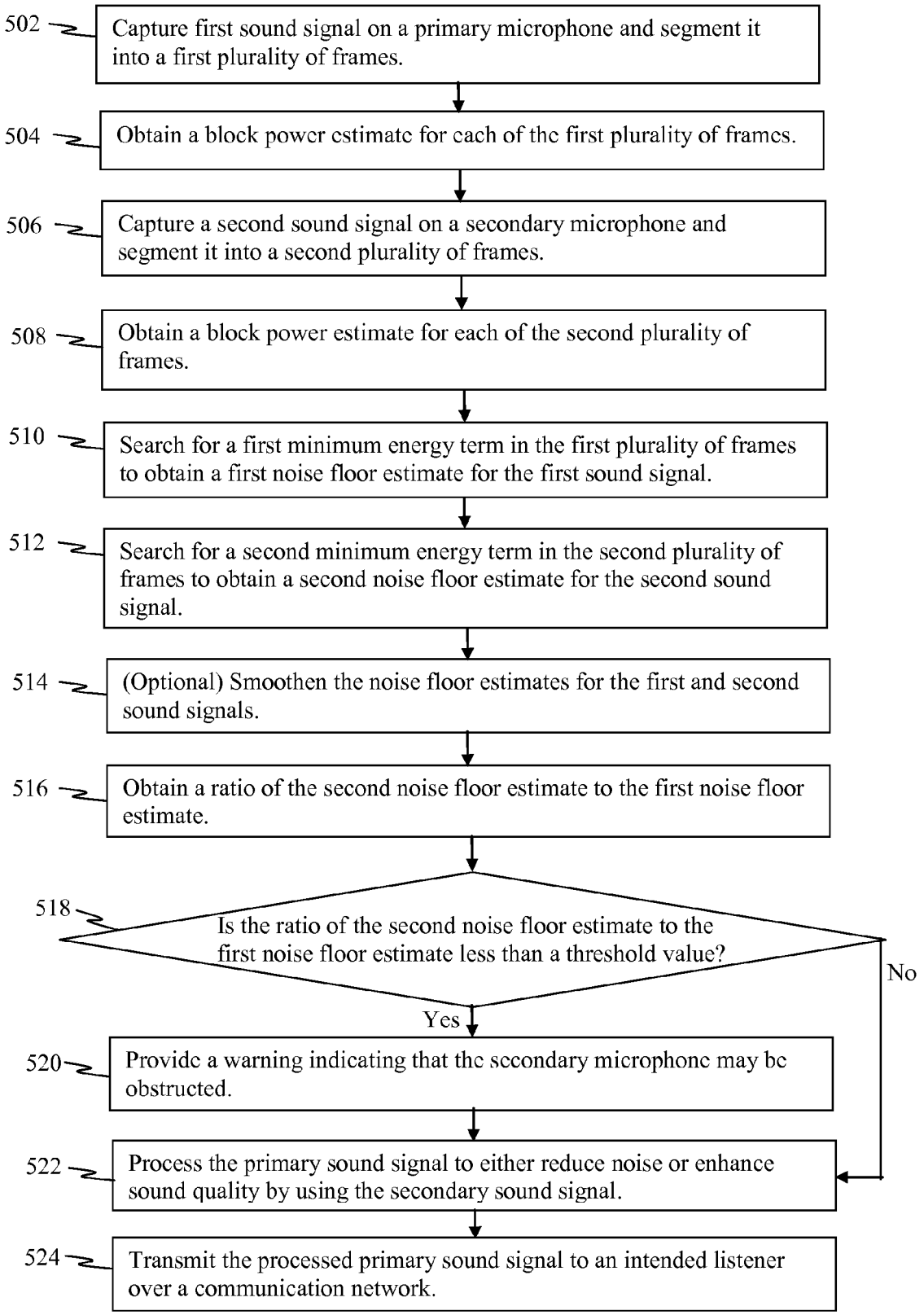
FIG. 5 is a flow diagram illustrating an example of how two microphones are monitored and estimates of noise level in the two microphones are computed to detect whether a secondary microphone is obstructed.

FIG. 5 is a flow diagram illustrating an example of how two microphones are monitored and estimates of noise level in the two microphones are computed to detect whether a secondary microphone is obstructed. A first sound signal is captured by a primary microphone and segmented into a first plurality of frames 502, where each frame may have length of N samples. A second sound signal is captured by a secondary microphone and segmented into a second plurality of frames 506.

In one example, segmentation of the sound signals into frames may be performed by analog-to-digital converters that sample the signals and passes the samples to preset buffers. Each buffer may be sized to provide a frame corresponding to one of the sampled sound signals. An analog-to-digital converter and corresponding buffer may be referred to as a signal segmenter.

The primary and secondary microphone signals may be denoted by the variables $s_1(n)$ and $s_2(n)$, where n represents time in samples. Block power estimates may be calculated for each frame 504 and 508 by adding, for example, the power values of all the samples in the frame. For example, the block power estimate calculation may be performed according to Equations 1 and 2:

$$P_1(k) = \sum_{i=0}^{N-1} s_1^2(kN+i) \qquad \text{(Equation 1 \& 2)}$$

$$P_2(k) = \sum_{i=0}^{N-1} s_2^2(kN+i) \;\; k \in Z$$

where $P_1(k)$ and $P_2(k)$ denote the block power estimates for the primary and secondary microphone signals $s_1$ and $s_2$, respectively, k denotes a block index or a frame index for the blocks or frames for each signal.

The noise floor estimates may be obtained by tracking the minimum power estimates of the respective microphone signals. Noise floor estimates of the two microphone signals may be computed by searching for the minimum of the block power estimates over several frames, say K consecutive frames, for example, according to Equations 3 and 4:

$$N_1(m) = \underset{K_frames}{\text{Min}} \{P_1(k), P_1(k-1), \ldots, P_1(k-K+1)\} \qquad \text{(Equation 3 \& 4)}$$

$$N_2(m) = \underset{K_frames}{\text{Min}} \{P_2(k), P_2(k-1), \ldots, P_2(k-K+1)\} \;\; m \in Z$$

where $N_1(m)$ and $N_2(m)$ denote the noise floor estimates of the primary and secondary microphone signals, respectively, and m denotes the multiple frame index that corresponds to a period of K consecutive frames. Consequently, the first plurality of frames may be searched to obtain a first minimum energy term corresponding to a first noise floor estimate for the first sound signal 510. Similarly, the second plurality of frames may be searched to obtain a second minimum energy term corresponding to a second noise floor estimate for the first sound signal 512.

Figure 6:
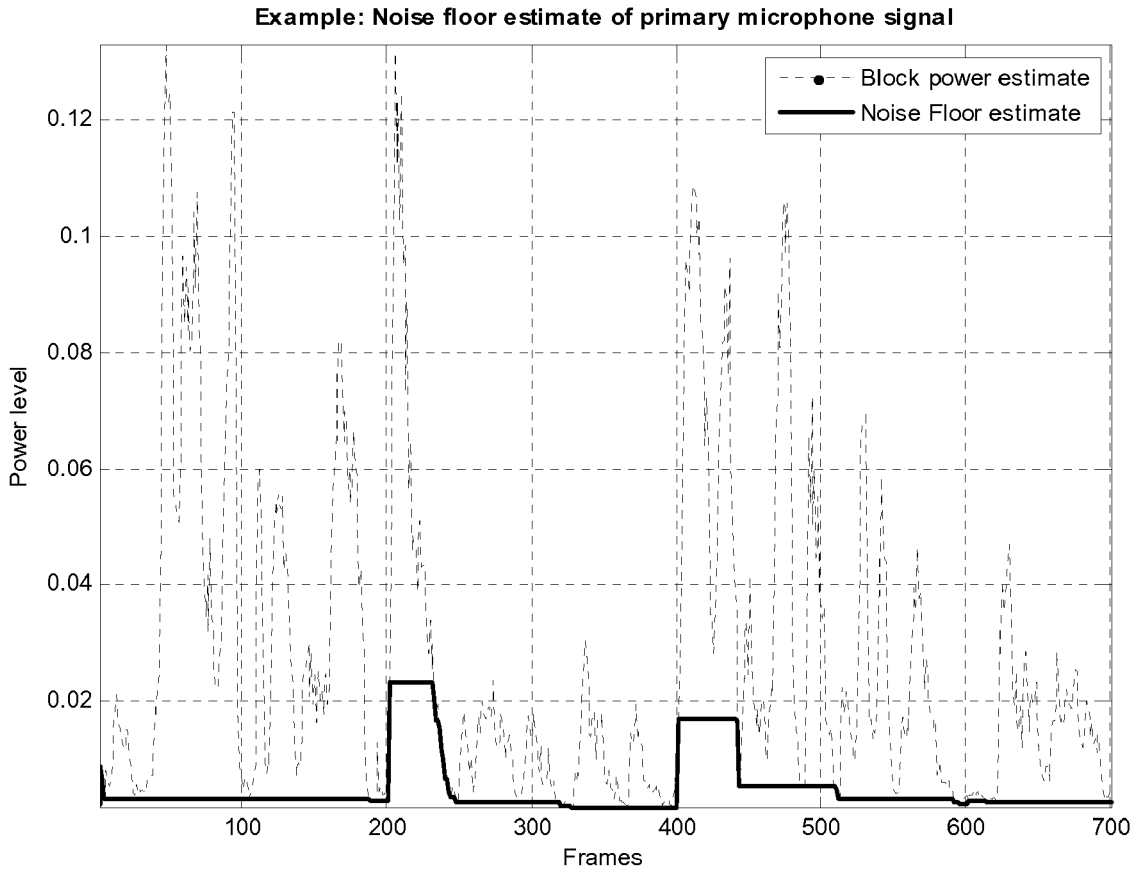
FIG. 6 is a graphical illustration of a noise floor computation procedure according to one example.

In one example, the noise floor estimate may be computed once in every K consecutive frames and its value is retained until the noise floor estimate is computed again after the next K consecutive frames. FIG. 6 is a graphical illustration of a noise floor computation procedure, where the noise floor is estimated once every two hundred (200) frames. In this example, the noise floor estimate may be obtained by using a block of two hundred (200) frames. The noise floor estimates may also be smoothed over time in order to minimize discontinuities at the transition of the estimates 514. The smoothing can be performed using a simple iterative procedure illustrated by Equations 5 and 6:

$$N_p(m) = \beta_1 N_p(m-1) + (1-\beta_1) N_1(m) \; 0 < \beta_1 < 1$$

$$N_s(m) = \beta_2 N_s(m-1) + (1-\beta_2) N_2(m) \; 0 < \beta_2 < 1 \qquad \text{(Equations 5 \& 6)}$$

where $N_p(m)$ and $N_s(m)$ denote the smooth noise floor estimates of the primary and secondary microphone signals respectively, and $\beta_1$ and $\beta_2$ denote the smoothing factor for averaging the noise floor estimates of the primary and secondary microphone signals respectively. The smoothed noise floor estimates $N_p(m)$ and $N_s(m)$ may represent estimates of the average background noise power in the primary and secondary microphone signals, respectively. Here, the smoothing factor $\beta_2$ may be chosen lower than $\beta_1$ in order to allow faster tracking of noise level in the secondary microphone signal.

Detection Procedure

The testing criterion for microphone covering detection may be implemented, for example, by obtaining a ratio of the second noise floor estimate (secondary sound signal) to the first noise floor estimate (primary sound signal) 516. The detection may be performed by determining whether the ratio of the second noise floor estimate to the first noise floor estimate less than a threshold value 518 as follows:

$$\frac{N_s(m)}{N_p(m)} \le \eta \qquad \text{(Equation 7)}$$

where m denotes a multiple frame index (e.g., a plurality of frames).

If the ratio is less than or equal to the threshold value $\eta$, the secondary microphone may be assumed to be covered and a warning may be provided to the user 520. To achieve good detection performance, the threshold $\eta$ may be selected based on knowledge of the difference between the sensitivities of the primary and secondary microphones.

There may, however, be a problem with using noise floor estimate for measuring the noise level in the microphone signal. Noise floor estimation typically suffers from considerable delay due to the minima searching over several frames. When the secondary microphone is covered, its noise floor estimate, $N_s(m)$, may reflect the noise level dip due to microphone covering only after several frames. This delay may not be tolerable if faster detection of microphone covering is desired. On the other hand, the primary microphone does not typically get covered (e.g., accidentally, unintentionally, purposefully or otherwise), and delay in the noise floor estimation of the primary microphone signal may be tolerable. Hence, an alternate detection criterion for performing faster detection of secondary microphone covering may be used.

The primary sound signal may then be processed to either reduce noise or enhance sound quality (or both) by using the secondary sound signal 522. The processed primary sound signal may then be transmitted to an intended listener over a communication network 524.

Figure 7:
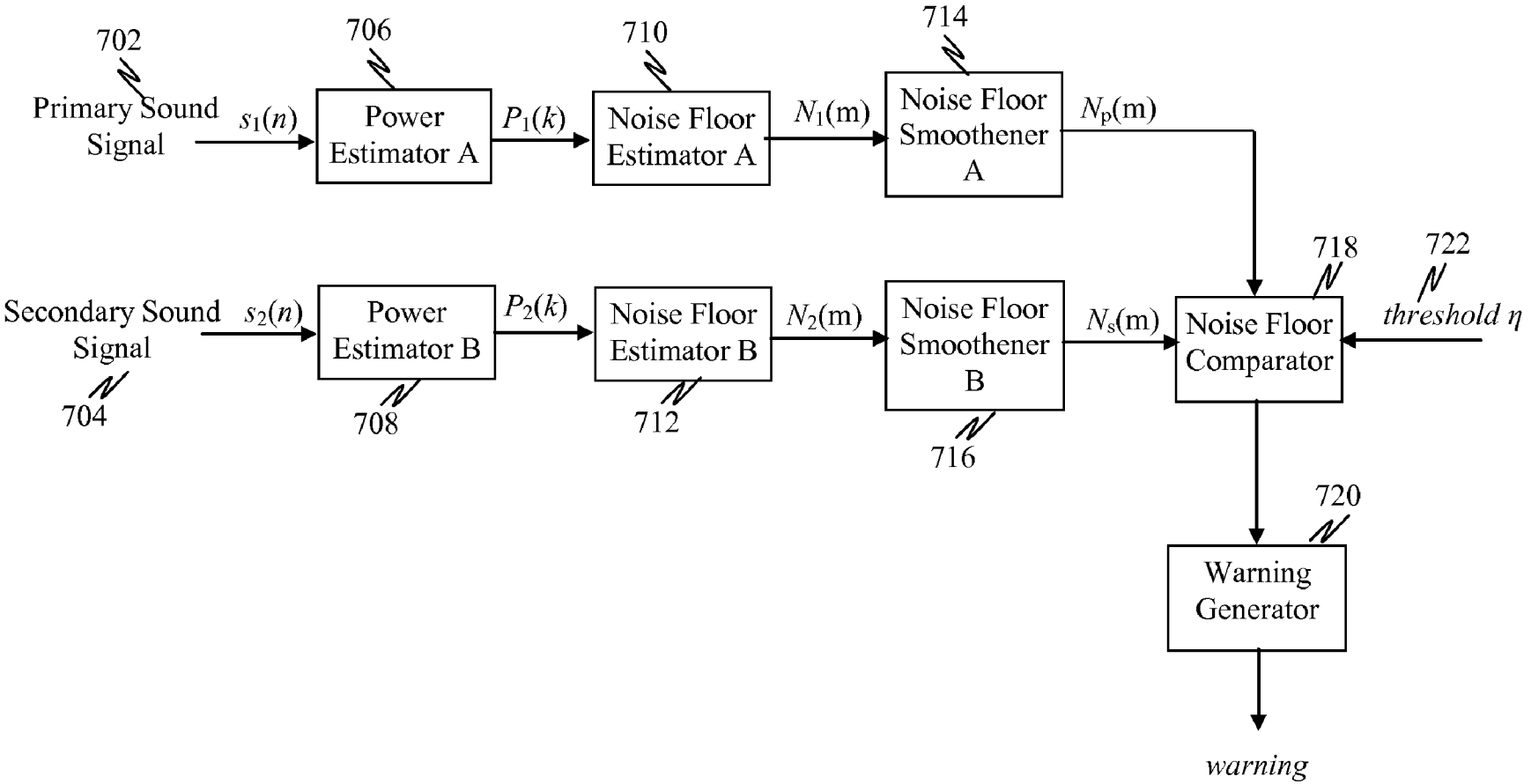
FIG. 7 is a functional block diagram illustrating the operation of a secondary microphone cover detector according to one example.

FIG. 7 is a functional block diagram illustrating the operation of a secondary microphone cover detector according to one example, as described by equations 1-7. A primary sound signal 702 and a secondary sound signal 704 are passed through power estimators A 706 and B 708 to obtain block power estimates $P_1(k)$ and $P_2(k)$. The block power estimates $P_1(k)$ and $P_2(k)$ are then passed through noise floor estimators A 710 and B 712 to obtain respective noise floor estimates $N_1(m)$ and $N_2(m)$. The noise floor estimates $N_1(m)$ and $N_2(m)$ may be smoothened by noise floor smoothers A 714 and B 716, respectively. A noise floor comparator 718 may then compare the smoothen noise floor estimates $N_p(m)$ and $N_s(m)$ for the primary and secondary sound signals 702 and 704, respectively. For example, if the ratio between the secondary smoothened noise floor estimate $N_s(m)$ to the primary smoothened noise floor estimate $N_p(m)$ is less than or equal to a threshold value 722, then a warning signal may be sent by a warning generator 720.

Figure 8:
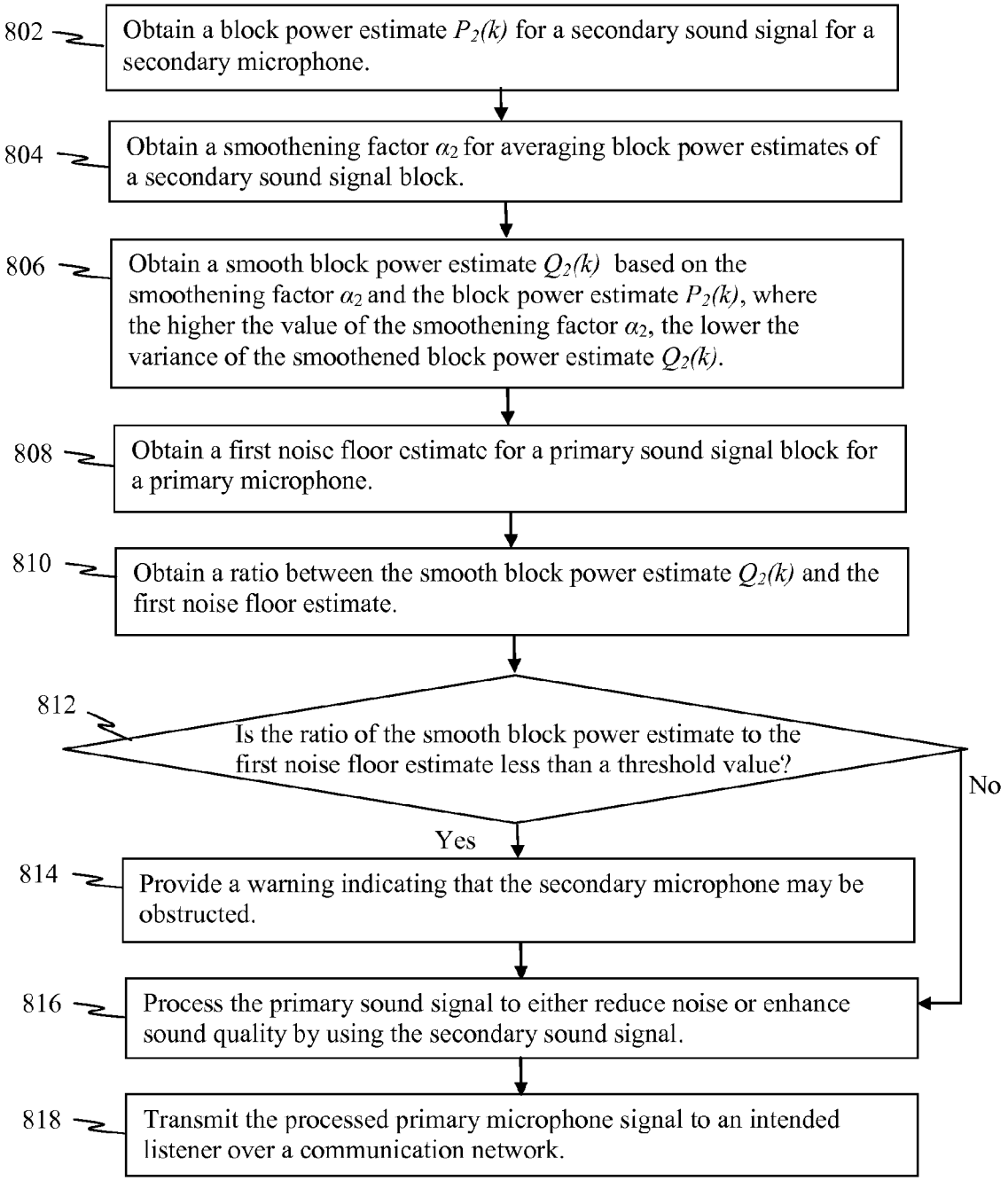
FIG. 8 illustrates an alternate method for obtaining a smooth block power estimate for a secondary microphone sound signal from a secondary microphone.

FIG. 8 illustrates an alternate method for obtaining a smooth block power estimate for a secondary sound signal from a secondary microphone. A block power estimate $P_2(k)$ may be obtained for the secondary sound signal for a secondary microphone 802. A smoothening factor $\alpha_2$ may be obtained for averaging block power estimates of a secondary sound signal block 804. A smooth block power estimate $Q_2(k)$ is may then be obtained based on the smoothening factor $\alpha_2$ and the block power estimate $P_2(k)$, where the higher the value of the smoothening factor $\alpha_2$, the lower the variance of the smoothened block power estimate $Q_2(k)$ 806. The smooth block power estimate $Q_2(k)$ may be used as an estimate of the noise level in the secondary sound signal. In one example, the smooth block power estimate $Q_2(k)$ may be computed, for example, based on Equation 8:

$$Q_2(k)=\alpha_2 Q_2(k-1)+(1-\alpha_2)P_2(k) 0<\alpha_1<1 \quad \text{(Equation 8)}$$

where k denotes a block index or a frame index for the blocks or frames for the secondary sound signal, and $\alpha_2$ denotes the smoothening factor for averaging the block power estimates of the secondary sound signal. The higher the value of the smoothening factor $\alpha_2$, the lower the variance of the smoothened block power estimate $Q_2(k)$.

A first noise floor estimate may be obtained for a primary sound signal block for a primary microphone 808, where the primary sound signal block corresponds to the secondary sound signal block (e.g., the signal blocks may be obtained within overlapping time windows). This first noise floor estimate may be smoothened over a range of signal blocks to minimize discontinuities in the estimates. A ratio between the smooth block power estimate $Q_2(k)$ and the first noise floor estimate may then be obtained 810, for example, by Equation 9:

$$\frac{Q_2(k)}{N_p(m)} < \eta' \quad \text{(Equation 9)}$$

$$Mm \le k < M(m+1)$$

where k denotes a block index or a frame index, m denotes a multiple frame index, and M is an integer. A determination may then be made as to whether the ratio of the smooth block power estimate to the (smooth) noise floor estimate is less than a threshold value η' 812. If the test ratio is less than the threshold η', it may be declared that the secondary microphone is covered and a warning may be provided indicating that the secondary microphone may be obstructed 814. Note that, if the secondary microphone is not covered, then the smooth block power estimate $Q_2(k)$ may be an over estimate of the noise level in the secondary sound signal. If the secondary microphone is partially covered, this method may not detect such condition well. However, the threshold η' may be raised or lowered until a desired detection performance is achieved.

The primary sound signal (e.g., for a primary microphone) may be processed to either reduce noise or enhance sound quality (or both) by using the secondary sound signal 816 before it is transmitted to an intended listener over a communication network 818.

Finally, the detection may also be made more robust by monitoring the detector output over a number of frames and testing if the detector consistently detects secondary microphone covering for at least, say 80% of the time.

Once enough detections are observed, it is determined whether the secondary microphone is covered and a warning signal may be issued to the controlling processor of the communication device or mobile device. The warning signal may be as simple as setting the microphone cover status flag to one (1) if the detection is made and setting it back to zero (0) when the detection fails. For instance, such warning signal may cause, for example, an audio signal to be acoustically transmitted to the user, or a text or graphic indicator or message to be displayed to the user (on a display screen for the mobile device), a light to blink on the mobile device, or a vibration of the mobile device.

Figure 9:
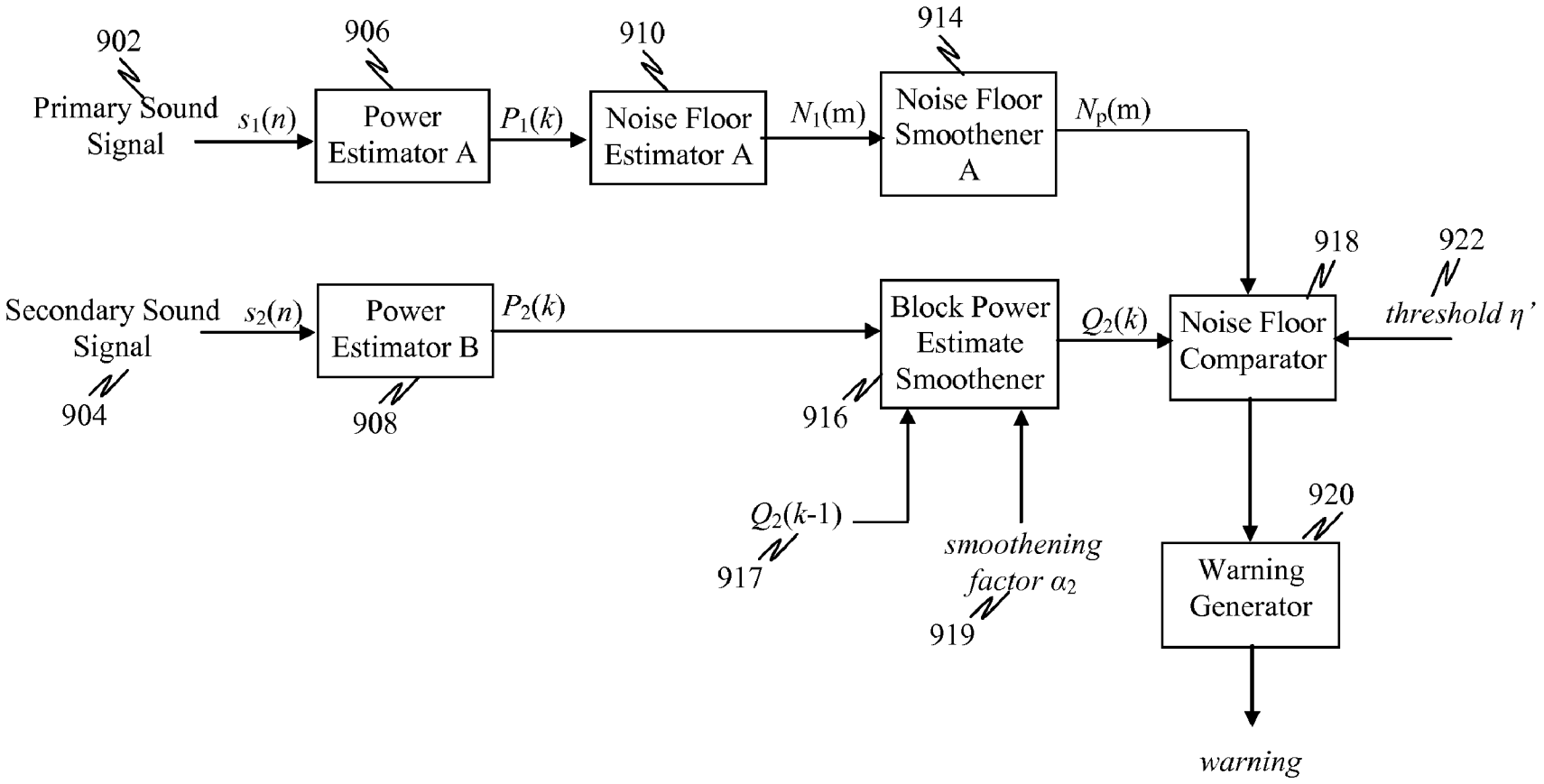
FIG. 9 is a functional block diagram illustrating the operation of a secondary microphone cover detector according to one example.

FIG. 9 is a functional block diagram illustrating the operation of a secondary microphone cover detector according to one example. A primary sound signal 902 and a secondary sound signal 904 may be passed through power estimators A 906 and B 908 to obtain block power estimates $P_1(k)$ and $P_2(k)$. A first block power estimate $P_1(k)$ may then be passed through noise floor estimator A 910 to obtain a noise floor estimate $N_1(m)$. The noise floor estimate $N_1(m)$ may be smoothened by noise floor smoothener A 914. A second block power estimate $P_2(k)$ may then be passed through a block power estimate smoothener 916 to obtain a current smooth block power estimate $Q_2(k)$ based on, for example, a smoothening factor 917 and a previous smooth block power estimate $Q_2(k-1)$ 919. A comparator 918 may then compare the smooth block power estimate $Q_2(k)$ and the first noise floor estimate $N_p(m)$. For example, this comparison may involve, for example, determining whether a ratio of the smooth block power estimate $Q_2(k)$ to the (smooth) noise floor estimate $N_p(m)$ is less than a threshold value η'. If the ratio is less than or equal to a threshold value 922, then a warning signal may be sent by a warning generator 920.

According to yet another configuration, a circuit in a mobile device may be configured or adapted to receive a first acoustic signal via a primary microphone to obtain a primary sound signal. The same circuit, a different circuit, or a second section of the same or different circuit may be configured or adapted to receive a second acoustic signal via a secondary microphone to obtain a secondary sound signal. In addition, the same circuit, a different circuit, or a third section of the same or different circuit may be configured or adapted to obtain a first signal characteristic for the primary sound signal. Similarly, the same circuit, a different circuit, or a fourth section may be configured or adapted to obtain a second signal characteristic for the secondary sound signal. The portions of the circuit configured or adapted to obtain the first and second sound signals may be directly or indirectly coupled to the portion of the circuit(s) that obtain the signal characteristics, or it may be the same circuit. A fourth section of the same or a different circuit may be configured or adapted to determine whether the secondary microphone is obstructed based on the first signal characteristic and second signal characteristic. For instance, the first signal characteristic may be a first noise floor estimate for the primary sound signal and the second signal characteristic may be a second noise floor estimate for the secondary sound signal. In another example, the first signal characteristic is a first noise floor estimate for the primary sound signal and the second signal characteristic is a second smoothened power estimate for the secondary sound signal. A fifth section of the same or a different circuit may be configured or adapted to provide a warning indicating that the secondary microphone is obstructed. The fifth section may advantageously be coupled to the fourth section, or it may be embodied in the same circuit as the fourth section. One of ordinary skill in the art will recognize that, generally, most of the processing described in this disclosure may be implemented in a similar fashion. Any of the circuit(s) or circuit sections may be implemented alone or in combination as part of an integrated circuit with one or more processors. The one or more of the circuits may be implemented on an integrated circuit, an Advance RISC Machine (ARM) processor, a digital signal processor (DSP), a general purpose processor, etc.

In various examples, the obstruction detection method described herein is illustrated for few types of mobile devices and microphone configurations. However, this method is not limited to a fixed type of mobile device or microphone configuration. Furthermore, in a mobile device with multiple secondary microphones, the proposed detection procedure can be used for detecting covering of any of the secondary microphones.

One or more of the components, steps, and/or functions illustrated in FIGS. 1, 2, 3, 4, 5, 6, 7, 8 and/or 9 may be rearranged and/or combined into a single component, step, or function or embodied in several components, steps, or functions. Additional elements, components, steps, and/or functions may also be added. The apparatus, devices, and/or components illustrated in FIGS. 1, 2, 3, 7 and/or 9 may be configured or adapted to perform one or more of the methods, features, or steps described in FIGS. 4, 5, 6 and/or 8. The algorithms described herein may be efficiently implemented in software and/or embedded hardware.

Those of skill in the art would further appreciate that the various illustrative logical blocks, modules, circuits, and algorithm steps described in connection with the configurations disclosed herein may be implemented as electronic hardware, computer software, or combinations of both. To clearly illustrate this interchangeability of hardware and software, various illustrative components, blocks, modules, circuits, and steps have been described above generally in terms of their functionality. Whether such functionality is implemented as hardware or software depends upon the particular application and design constraints imposed on the overall system.

The various features described herein can be implemented in different systems. For example, the secondary microphone cover detector may be implemented in a single circuit or module, on separate circuits or modules, executed by one or more processors, executed by computer-readable instructions incorporated in a machine-readable or computer-readable medium, and/or embodied in a handheld device, mobile computer, and/or mobile phone.

It should be noted that the foregoing configurations are merely examples and are not to be construed as limiting the claims. The description of the configurations is intended to be illustrative, and not to limit the scope of the claims. As such, the present teachings can be readily applied to other types of apparatuses and many alternatives, modifications, and variations will be apparent to those skilled in the art.

What is claimed is:

1. A method for improving sound capture on a mobile device, comprising:

receiving a first acoustic signal via a primary microphone to obtain a primary sound signal;

receiving a second acoustic signal via a secondary microphone to obtain a secondary sound signal;

determining a first signal characteristic for the primary sound signal;

determining a second signal characteristic for the secondary sound signal;

determining whether the secondary microphone is obstructed during a voice communication based on the first signal characteristic and second signal characteristic; and providing a warning indicating that the secondary microphone is obstructed.

2. The method of claim 1 wherein the primary sound signal and the secondary sound signal are obtained within overlapping time windows.

3. The method of claim 1 wherein the secondary sound signal is used to improve the sound quality of the primary sound signal.

4. The method of claim 1 wherein determining whether the secondary microphone is obstructed based on the first signal characteristic and second signal characteristic includes, determining whether a ratio between the second signal characteristic and first signal characteristic is less than a threshold; and providing the warning if the ratio is less than the threshold.

5. The method of claim 4 further comprising:

obtaining a first sensitivity corresponding to the primary microphone and a second sensitivity corresponding to the secondary microphone.

6. The method of claim 5 further comprising:

obtaining the threshold based on the difference between the first sensitivity and the second sensitivity.

7. The method of claim 5 wherein the first sensitivity of the primary microphone and second sensitivity of the secondary microphone are obtained for a given level of sound pressure.

8. The method of claim 1, further comprising:

processing the primary sound signal to either reduce noise or enhance sound quality by using the secondary sound signal; and transmitting the processed primary sound signal to an intended listener over a communication network.

9. The method of claim 1 wherein the first and second acoustic signals originate from a source external to the mobile.

10. The method of claim 1, wherein the obstruction detected is a temporary external obstruction of the secondary microphone.

11. The method of claim 1, wherein determining the first signal characteristic for the primary sound signal includes segmenting the primary sound signal into a first plurality of frames;

estimating a block power for each of the first plurality of frames; and searching for a minimum energy term in the first plurality of frames to obtain a first noise floor estimate for the primary sound signal, wherein the first noise floor estimate is the noise level for the primary sound signal.

12. The method of claim 11, wherein determining the second signal characteristic for the secondary sound signal includes segmenting the secondary sound signal into a second plurality of frames;

estimating a block power for each of the second plurality of frames; and searching for a minimum energy term in the second plurality of frames to obtain a second noise floor estimate for the secondary sound signal, wherein the second noise floor estimate is the noise level for the secondary sound signal.

13. The method of claim 12, wherein determining whether the secondary microphone is obstructed includes obtaining a ratio of the second noise floor estimate to the first noise floor estimate; and determining whether the ratio is less than a threshold.

14. The method of claim 1 wherein the warning is provided through at least one of a sound signal, a vibration of the mobile device, and a visual indicator.

15. The method of claim 1 wherein the first signal characteristic is a first noise level for the primary sound signal and the second signal characteristic is a second power level for the secondary sound signal.

16. The method of claim 1 further comprising:

obtaining a block power estimate for the secondary sound signal for the secondary microphone;

obtaining a smoothening factor for the secondary sound signal;

obtaining a smooth block power estimate for the secondary sound signal based on the smoothening factor and the block power estimate;

obtaining a first noise floor estimate for a primary microphone signal block for the primary microphone;

obtaining a ratio between the smooth block power estimate and the first noise floor estimate; and determining whether the ratio is less than a threshold.

17. The method of claim 1 further comprising:

dynamically selecting the primary microphone from a plurality of microphones based on which microphone has either the highest signal energy or highest signal-to-noise ratio at a particular period of time.

18. A mobile device comprising:

a primary microphone configured to obtain a first sound signal;

a secondary microphone configured to obtain a second sound signal; and a secondary microphone cover detection module configured to determine a first signal characteristic for the first sound signal;

determine a second signal characteristic for the second sound signal;

determine whether the secondary microphone is obstructed during a voice communication based on the first signal characteristic and second signal characteristic; and provide a warning indicating that the secondary microphone is obstructed.

19. The mobile device of claim 18 wherein the warning is provided through at least one of an audio signal, a vibration of the mobile device, and a visual indicator.

20. The mobile device of claim 18 wherein the first sound signal and the second sound signal are obtained within overlapping time windows.

21. The mobile device of claim 18 wherein the first and second signals originate from at least one acoustic signal external to the mobile device.

22. The mobile device of claim 18 wherein determining whether the secondary microphone is obstructed based on the first signal characteristic and second signal characteristic, the secondary microphone cover detection module is further configured to determine whether a ratio between the second signal characteristic and first signal characteristic is less than a threshold.

23. The mobile device of claim 22, wherein the secondary microphone cover detection module is further configured to obtain a first sensitivity corresponding to the primary microphone and a second sensitivity corresponding to the secondary microphone, wherein the first sensitivity of the primary microphone and second sensitivity of the secondary microphone are obtained for a given level of sound pressure; and obtain a threshold based on the difference between the first sensitivity and the second sensitivity.

24. The mobile device of claim 18, wherein the secondary microphone cover detection module is further configured to process the first sound signal to either reduce noise or enhance sound quality by using the second sound signal; and transmit the processed first sound signal to an intended listener over a communication network.

25. The mobile device of claim 18, wherein the obstruction detected is a temporary external obstruction of the secondary microphone.

26. The mobile device of claim 18, wherein the secondary microphone cover detection module is further configured to dynamically select the primary microphone from the plurality of microphones based on which microphone has either the highest signal energy or highest signal-to-noise ratio at a particular period of time.

27. The mobile device of claim 18 wherein the first signal characteristic is a first noise floor estimate for the first sound signal and the second signal characteristic is a second noise floor estimate for the second sound signal, and the second microphone cover detection module is further configured to determine whether a ratio between the second noise floor estimate and the first noise floor estimate is less than a threshold.

28. The mobile device of claim 18, wherein the first signal characteristic is a first noise floor estimate for the first sound signal and the second signal characteristic is a second smoothened power estimate for the second sound signal, and the second microphone cover detection module is further configured to determine whether a ratio between the second smoothened power estimate and the first noise floor estimate is less than a threshold.

29. A mobile device comprising:

means for receiving a first acoustic signal via a primary microphone to obtain a primary sound signal;

means for receiving a second acoustic signal via a secondary microphone to obtain a secondary sound signal;

means for determining a first signal characteristic for the primary sound signal;

means for determining a second signal characteristic for the secondary sound signal;

means for determining whether the secondary microphone is obstructed during a voice communication based on the first signal characteristic and second signal characteristic; and means for providing a warning indicating that the secondary microphone is obstructed.

30. The mobile device of claim 29 wherein the first signal characteristic is a first noise floor estimate for the primary sound signal and the second signal characteristic is a second noise floor estimate for the secondary sound signal.

31. The mobile device of claim 29, wherein the first signal characteristic is a first noise floor estimate for the primary sound signal and the second signal characteristic is a second smoothened power estimate for the secondary sound signal.

32. A circuit for improving sound capture in a mobile device, wherein the circuit is adapted to receive a first acoustic signal via a primary microphone to obtain a primary sound signal;

receive a second acoustic signal via a secondary microphone to obtain a secondary sound signal;

obtain a first signal characteristic for the primary sound signal;

obtain a second signal characteristic for the secondary sound signal;

determine whether the secondary microphone is obstructed during a voice communication based on the first signal characteristic and second signal characteristic; and provide a warning indicating that the secondary microphone is obstructed.

33. The circuit of claim 32 wherein the first signal characteristic is a first noise floor estimate for the primary sound signal and the second signal characteristic is a second noise floor estimate for the secondary sound signal, and, to determine whether the secondary microphone is obstructed, the circuit is further adapted to determine whether a ratio between the second noise floor estimate and the first noise floor estimate is less than a threshold.

34. The circuit of claim 32, wherein the first signal characteristic is a first noise floor estimate for the primary sound signal and the second signal characteristic is a second smoothened power estimate for the secondary sound signal, and, to determine whether the secondary microphone is obstructed, the circuit is further adapted to determine whether a ratio between the second smoothened power estimate and the first noise floor estimate is less than a threshold.

35. The circuit of claim 32, wherein the circuit is an integrated circuit.

36. A computer-readable medium comprising instructions improving sound capture on a mobile device, which when executed by a processor causes the processor to receive a first acoustic signal via a primary microphone to obtain a primary sound signal;

receive a second acoustic signal via a secondary microphone to obtain a secondary sound signal;

determine a first signal characteristic for the primary sound signal;

determine a second signal characteristic for the secondary sound signal;

determine whether the secondary microphone is obstructed during a voice communication based on the first signal characteristic and second signal characteristic; and provide a warning indicating that the secondary microphone is obstructed.

37. The computer-readable medium of claim 36 further comprising instructions which when executed by a processor causes the processor to dynamically select the primary microphone from the plurality of microphones based on which microphone has either the highest signal energy or highest signal-to-noise ratio at a particular period of time.

* * * * *